United States Patent [19]

Cleusix

[11] 4,427,301

[45] Jan. 24, 1984

[54] TIMEPIECE WITH AN ACTIVATING MECHANISM

[75] Inventor: Willy Cleusix, Le Landeron, Switzerland

[73] Assignee: Ebauches Electroniques S.A., Marin, Switzerland

[21] Appl. No.: 352,623

[22] Filed: Feb. 26, 1982

[30] Foreign Application Priority Data

Feb. 26, 1981 [CH] Switzerland ..... 1319/81

[51] Int. Cl.[3] ..... G04B 23/02

[52] U.S. Cl. ..... 368/72; 368/252

[58] Field of Search ..... 368/252–254, 368/72–74; 200/36, 37 R

[56] References Cited

U.S. PATENT DOCUMENTS

| | | | |
|---|---|---|---|
| 4,098,071 | 7/1978 | Kawakami et al. | 368/73 |
| 4,098,071 | 7/1978 | Kawakami et al. | 368/73 |
| 4,196,583 | 4/1980 | Komaki | 368/74 X |
| 4,199,930 | 4/1980 | Lebet et al. | 368/252 |
| 4,351,043 | 9/1982 | Ogihara et al. | 368/252 |

*Primary Examiner*—Ulysses Weldon

*Attorney, Agent, or Firm*—Pollock, Vande Sande & Priddy

[57] ABSTRACT

The alarm wheel (5) is mounted with axial clearance between an insulating plate (6) and a wheel (8).

This wheel (5) is in mesh with the hour cannon wheel (3). It has an embossment (5*a*) which, once during each turn, passes in front of a magnet (9) carried by the plate (6). The wheel (5) is then attracted axially and its embossment (5*a*) enters into contact with the magnet (9), grounding the latter. Now, the magnet (9) being in permanent contact with one of the conductive tracks (13) of the printed circuit of the watch, this track (13) is thus grounded. The user of the watch can alter the time at which the releases are produced by altering the angular position of the plate (6). No spring acts axially on the alarm wheel (5) which moves freely between the wheel (8) and an annular rib (6*e*) provided on the plate 6.

10 Claims, 3 Drawing Figures

1
2
3
3a
4
5
5a
6
6a
6b
6c
6d
6e
7
8
8a
9
9a
10
10a
11
12
13
14
15
16
17
18
19
100
II 6
6d
9
10
10a
III 5
5a
6
6a
6c
6d
6e
8
8a
9
10
10a
15
19

TIMEPIECE WITH AN ACTIVATING MECHANISM

FIELD OF THE INVENTION

The present invention relates to a timepiece with an activating or triggering mechanism designed to effect the closing of an electrical contact. In particular this mechanism may be the release mechanism of an alarm watch.

BACKGROUND OF THE INVENTION

Swiss Patent No. 526,154 describes an alarm watch having a release mechanism comprising a wheel made of insulating material, the angular position of which can be adjusted, and a metal arm formed integrally with the pipe of the hour cannon wheel of the watch. A spring urges the insulating wheel against a projection located at the end of the said metal arm. The release of the alarm is produced when a contact member constituted by the said projection enters into contact with a second contact member which is carried by the insulating wheel.

One of the disadvantages of this known mechanism is that the metal arm is subjected, while it is rotating, due to the action of the return spring, to a considerable amount of energy-consuming friction. Now, in the case of electronic watches, where the source of energy is constituted by an electric battery cell, which has limited life, anything that causes an increase in consumption should obviously be avoided.

One object of the present invention is to avoid this disadvantage.

BRIEF SUMMARY OF THE INVENTION

According to the invention the bringing into contact of the two contact members, at the moment when they are in registering relation with each other, is ensured by a device comprising a permanent magnet which is rigid or integral with one of the contact members and a magnetic metal part which is rigid or integral with the other contact member.

Thus, it is no longer necessary to rely on a spring engaging the support of one of the contact members for bringing said members into contact. This reduces the amount of energy lost in frictional engagements between the different components of the release mechanism.

According to a preferred embodiment, one contact member is an electrically conductive permanent magnet while the other contact member is made of a magnetic metal.

BRIEF DESCRIPTION OF THE DRAWINGS

The invention will be better appreciated from the following description of an embodiment given by way of example, with reference to the accompanying drawings in which.

DETAILED DESCRIPTION OF A PREFERRED EMBODIMENT

Figure 1:
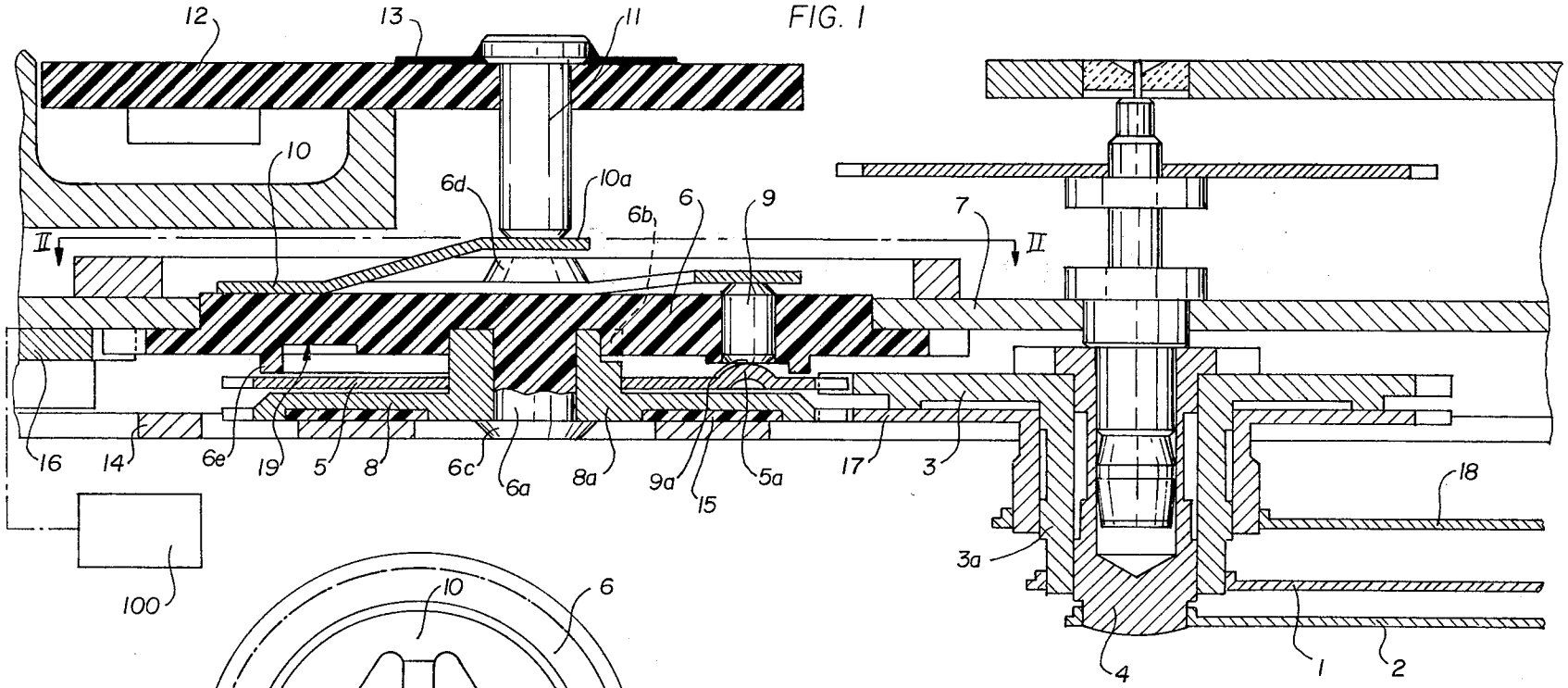
FIG. 1 is an axial section of part of an electronic alarm watch in which only the parts that are necessary for the unterstanding of the invention have been shown.

The watch shown in the drawings is of the electromechanical type, the time indicators being constituted by an ordinary hour hand 1 and minute hand 2, the former being mounted on the pipe 3*a* of the hour cannon wheel 3 and the latter by the centre wheel 4. The electrical drive mechanism of the watch has not been shown since it is known per se. It could be constituted by a stepping motor controlled by a quartz resonator via a suitable divider circuit. The energy will be supplied by an electric cell.

The hour cannon wheel 3 is in mesh with an alarm wheel 5 of a magnetic metal such as steel which is interposed, with axial clearance, between a toothed wheel 6 of electrically insulating material, which is rotatably mounted in the plate 7 of the movement, and a wheel 8 which is coaxial with the said insulating wheel 6. According to the example shown in FIG. 1, the gear ratio between the hour cannon wheel 3 and the alarm wheel 5 is 1:1, so that the alarm wheel makes one complete revolution every twelve hours, as does the wheel 3. This ratio may advantageously be of 1:2 so that the alarm wheel 5 makes one complete revolution every twenty-four hours. The wheel 5 is grounded more particularly via the wheel 3 with which it is in permanent contact.

The insulating wheel 6 carries an electrically conductive contact in the form of a bar-type permanent magnet 9, the axis of which is parallel to that of the wheel 6 and the distance of which from the center corresponds to the distance from the center of a projecting contact—or embossment—5*a* provided on the wheel 5 and directed towards the insulating wheel 6. A shaft 6*a* of the wheel 6 extends through the wheel 8. Wheel 6 also has a projection 6*b* engaged in a recess in the pipe 8*a* so that the wheel 6 and 8 are coupled in rotation with each other. Wheels 6 and 8 are assembled together by a rivet head 6*c* located on the end of the shaft 6*a*.

Figure 2:
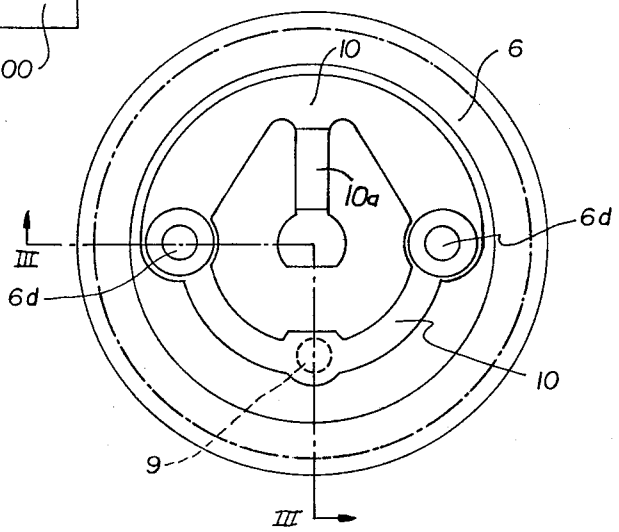
FIG. 2 is a plan view of a detail on an enlarged scale from the plane II—II in FIG. 1.
Figure 3:
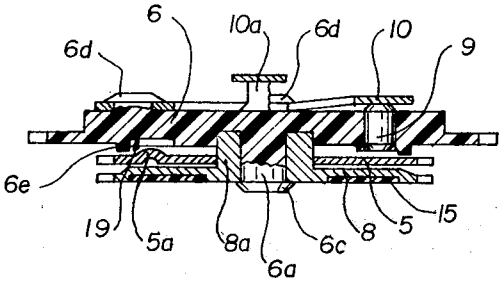
FIG. 3 is a vertical section following the line III—III of FIG. 2.

The wheel 6 carries, on the surface thereof opposite that which faces towards the wheel 5, a thin metal washer 10 in the form of a ring which is fixed to the said wheel 6 by means of two studs 6*d* located diametrically opposite each other (FIGS. 2 and 3). This ring 10 is provided with a radial arm 10*a* which is directed inwardly. This arm 10*a* bears resiliently against the end of a bolt 11 which is coaxial with the wheel 6 and which is carried by a printed circuit 12 of the watch. This bolt 11 is in electrical contact with one of the conductive tracks, indicated by 13, of the said circuit 12. The resilient arm 10*a* of the ring 10, acting as a spring, urges the assembly formed by the wheel 6 and the wheel 8 against a bridge piece 14 of the framework of the movement of the watch. This results in a slight resilient deformation of the bridge piece 14 which thus acts as a spring urging the rigid assembly formed by wheels 6 and 8 against the plate 7. The wheel 8 is fitted with a ring 15 of anti-friction plastics material by means of which it bears against the bridge piece 14.

The toothed wheel 6 is in mesh with a control pinion 16 which is manually operable by means of a control mechanism 100, known per se, which enables the angular position of the said wheel 6 to be altered manually. The control mechanism 100 may be for example of the type comprising a stem (not shown) movable axially and in rotation about its longitudinal axis. A clutch-wheel (not shown) mounted on said stem is able to mesh with the control pinion 16, when said stem is in an active position. The wheel 8 is in mesh with a supplementary cannon wheel 17. The latter is mounted on the pipe 3*a* of the cannon wheel 3 and has a pipe on which is mounted an indicating member such as an alarm-setting hand 18 for displaying a pre-settable alarm time which is the time at which an alarm bell (not shown) of the watch will be triggered.

The insulating wheel 6 is provided on its surface facing towards the alarm wheel 5, with an annular rib 6*e* coaxial with the said wheel 6. The distance of the rib 6*e* from the centre of the wheel 6 is greater than that between said center and the magnet 9. An annular groove 19 is provided in the said surface of the wheel 6 on the inner side of the rib 6*e* and is suitably dimensioned so that the embossment 5*a* of the wheel 5 does not enter into contact with the wheel 6, in any relative angular position of the wheels 5 and 6 in which the embossment 5*a* is not located opposite, or in registering relation with the magnet 9. The base of this groove 19 merges via two inclined planes with the flat end surface 9*a* on that end of the magnet 9 which is directed towards the wheel 5. This end surface 9*a* is set back with respect to the free edge of the rib 6*e*, so that the wheel 5 will not enter into contact with the magnet 9 when the latter is not opposite the embossed projection 5*a*. However, the set back of the end surface 9*a* with respect to the free edge of the rib 6*e* is sufficiently slight for the embossment 5*a* to enter into contact with the said surface 9*a* when the two elements 5*a* and 9*a* are in registering relation with each other.

The watch described hereabove and illustrated in the drawings operates as follows:

The time at which the alarm will be released or triggered is set by the user of the watch who rotates the wheel 16 by actuating the control mechanism 100, thereby adjusting the angular position of the insulating wheel 6. This angular position and consequently the time of release is displayed by the hand 18 which, driven by the wheel 8, is displaced opposite the ring of hour markings on the dial (not shown) of the watch.

On rotation of the alarm wheel 5, which is constantly driven by the hour cannon wheel 3, the embossment 5*a* is normally located opposite the annular groove 19.

Once during each revolution of the wheel 5, the embossment 5*a* of the latter arrives opposite the permanent magnet 9 which attracts it, thus producing a slight axial displacement of the wheel 5 accompanied by a slight rocking movement and a slight angular displacement within the limits permitted by the play between it and the hour cannon wheel 3. Thus, the material of the contact embossment 5*a* and the material of the permanent magnet contact bar 9 comprise a magnetic coupling means for bringing the two contact members into contact when they have been rotated with the support wheels 5 and 6 into positions opposite each other. The contact between the embossment 5*a* and the magnet 9 grounds the latter, since the wheel 5 is itself grounded via the wheels 3, as a result of which the conductive track 13 is grounded, via the ring 10 and the bolt 11. An electric circuit is thus closed which triggers the alarm bell of the watch. Although, as previously described, the contact embossment 5*a* preferably is made from a magnetic metal such as steel and the contact bar 9 preferably is made from a permanent magnet, it is also within the scope of the invention to form contact embossment 5*a* from a permanent magnet and contact bar 9 from a magnetic metal.

Due to this arrangement, the alarm release mechanism does not apply any overload to the movement of the watch and it consumes practically no energy. In addition, the contact is closed instantaneously, ensuring a free starting up of the alarm bell. Moreover, this mechanism is subject to practically no wear.

Alternatively, the signal produced by the present release mechanism could be used for other purposes, especially for closing, via a relay, a sub-circuit supplying for example a radio set which the user wishes to turn on automatically at a fixed time each day.

Likewise, this signal need not take place once or twice each day, but could take place at very different frequencies, for example once per month in the case where the user of the watch requires a monthly reminder.

While there are shown and described a preferred illustrative embodiment of the invention, it will be understood by those skilled in the art that other modifications may be made within the principles of the invention and the scope of the appended claims.

What is claimed:

1. A timepiece comprising a movement and an activating mechanism operatively connected to said movement for producing, at a presettable time, the closing of an electrical contact, the time-piece comprising:

a framework; a first contact member of a first material; a first support rotatably mounted on said framework and rotationally coupled to said movement, for carrying said first contact member; a second contact member of a second material; a second support mounted on said framework, in a position which is rotationally adjustable about the axis of rotation of said first support, for carrying said second contact member, said second contact member being located at substantially the same distance from said axis of rotation as said first contact member; and said first and second materials being chosen to comprise magnetic coupling means for bringing said first and second contact members into contact when they have been rotated with said supports into positions opposite each other.

2. The timepiece of claim 1, further comprising analog time-indicating means including a first wheel mounted on said framework and forming part of said movement, a pipe fixed coaxially to said first wheel and an hour hand mounted on said pipe and wherein said first support comprises a second wheel meshing with said first wheel.

3. The timepiece of claim 2, further comprising:

a member for displaying said pre-settable time, a third wheel mounted on said framework coaxially with said first wheel, and a second pipe fixed coaxially to said third wheel for carrying said displaying member, and wherein said second support comprises a first part carrying said second contact member and a second part in the form of a toothed wheel coaxial with the axis of rotation of said first support and meshing with said third wheel.

4. The timepiece of claim 1, wherein said magnetic coupling means comprises a permanent magnet integral with said second contact member and a magnetic metal part integral with said first contact member.

5. The timepiece of claim 4, wherein said first support comprises a magnetic metal and said first contact member is a projecting part of said first support.

6. The timepiece claim 4, further comprising a member for displaying said pre-settable time, said member being rotationally coupled with said second support.

7. The timepiece of claim 5, further comprising a toothed rotatable member mounted on said framework integral with said displaying member and wherein said second support comprises a first part carrying said second contact member and a second part in the form of a toothed wheel coaxial with the axis of said first support and meshing with said rotatable member.

8. The timepiece of claim 4, wherein said second support comprises a first part carrying said second contact member and a second part spaced apart from said first part in the direction of said axis of rotation, and wherein said first support is rotatably mounted on said second support between said first and second parts of the latter.

9. The timepiece of claim 4, wherein said first support is mounted on said second support rotatable about the axis of rotation thereof and with clearance in the direction of said axis.

10. The timepiece of claim 7, further comprising a fourth wheel mounted on said framework, means for manually adjusting the position in rotation of said fourth wheel, and wherein said first part has the form of a toothed wheel meshing with said fourth wheel.

* * * * *